United States Patent [19]

Jenkins

[11] Patent Number: 4,647,471

[45] Date of Patent: Mar. 3, 1987

[54] METHOD OF DISTRIBUTING LIQUID ONTO A SUBSTRATE

[75] Inventor: Walter N. Jenkins, West Glamorgan, Wales

[73] Assignee: National Research Development Corporation, London, England

[21] Appl. No.: 829,172

[22] Filed: Feb. 14, 1986

[30] Foreign Application Priority Data

Feb. 18, 1985 [GB] United Kingdom ..... 8504047
May 17, 1985 [GB] United Kingdom ..... 8512502

[51] Int. Cl.[4] ..... B05D 1/02

[52] U.S. Cl. ..... 427/37; 427/420; 427/421; 427/422; 239/290; 118/300; 118/DIG. 4

[58] Field of Search ..... 239/290, 299; 118/DIG. 4, 300; 427/37, 422, 420, 421

[56] References Cited

U.S. PATENT DOCUMENTS 2,088,542 7/1937 Westin ..... 239/290 X
4,066,117 1/1978 Clark et al. ..... 239/290 X

FOREIGN PATENT DOCUMENTS 1455862 11/1976 United Kingdom .

*Primary Examiner*—Shrive P. Beck
*Attorney, Agent, or Firm*—Cushman, Darby & Cushman

[57] ABSTRACT

A liquid stream 2 from a nozzle 1 is atomized and distributed over a substrate 3. The liquid falls into a downwardly angled chute 10 formed by strong gas jets focussed to a point X. An air-knife 20 directed vertically downwardly in the plane of X atomizes the liquid.

Gas-knives 12 and 13 are fired alternately and apply equal but opposite deflections to the liquid, which however remains in the plane of 20. The liquid is then evenly distributed on the substrate 3, which is advanced intersecting the plane of 20.

19 Claims, 3 Drawing Figures

METHOD OF DISTRIBUTING LIQUID ONTO A SUBSTRATE

This invention relates to a method of distributing liquid, such as paint or molten metal, onto a substrate. A long-standing problem has been to deposit such liquid to an even thickness, and various solutions have been proposed. In British Patent Specification No. 1455862, for example, spray atomised by a primary gas nozzle is cyclically deflected by secondary gas nozzles to scan the substrate.

According to the present invention, liquid is distributed onto a substrate by deflecting the liquid in two stages: in the first, an unsupported supply of the liquid (e.g. a stream pouring from a nozzle, or formed by striking an arc at one or two consumable electrodes) is allowed to fall into a chute, the chute not being solid but being comprised by a stream of gas, trough-shaped (preferably V-shaped or U-shaped) in cross-section, directed downhill preferably at 15°–30° to the vertical; and, in the second, the liquid (now deflected, accelerated and preferably partly atomised by the gas chute) meets a vertical or near-vertical plane containing: a gas-knife directed towards the substrate; and/or a plurality of sequentially repetitiously (preferably one of two alternately) fired gas-knives, the directions of flow from which intersect at a point vertically above the centreline of the chute, subtending an angle of up to 80° at that point, below which is the substrate.

Preferably the liquid in the second stage meets first the gas-knife directed towards the substrate and then the plurality of sequentially repetitiously fired gas-knives.

The liquid is propelled and distributed by the gas-knives, onto the substrate, which is preferably moving intersecting said plane. The chute may consist of a series of closely-spaced gas jets, and is preferably focussed to a point in said plane. Preferably the liquid falls into the chute on its centreline.

Preferably the gas flow in the chute is between one third and one half of the flow through the gas-knives but the minimum ratio is determined in practice as that which just produces a uniformly fine deposit. Small changes in the gas ratio can be used to correct deviations from a uniformly flat deposit. The total gas flow may be related to the liquid flow by known relationships governing the breaking up of liquid streams.

Instead of the preferred arrangement of two air-knives, there may be a greater number, and each may (non-preferably) consist of as little as one nozzle. The nozzles in such a case may be as described and illustrated in British Patent Application GB No. 2139249A, especially FIG. 4 thereof.

The method may comprise rotating the chute and gas-knife/knives. about the vertical axis containing the unsupported liquid, especially where there is only one gas-knife.

The invention extends to apparatus for distributing the liquid as set forth above.

The invention will now be described by way of example with reference to the accompanying drawings, in which incorporeal features such as sheets of gas have been shown as if visible, for ease of illustration. The drawings are not to scale; in particular, the substrate is larger and more distant than drawn.

In all Figures, from a vertically downward nozzle 1, which is of silicon nitride and is 3 mm in diameter, there issues a stream 2 of molten metal which is to be distributed on a substrate 3.

A stream of gas, V-shaped in cross-section, issues downhill from an injector nozzle block (not shown) and forms an injector or chute 10 angled at 25° to the vertical. The angle contained by the V is 90°. The gas stream forming the chute is focussed to a point X. The stream 2 falls towards the vertex of the chute 10, small deviations being strongly deleterious, and is deflected and slightly broken up, the liquid particles of the stream 2 tending to ride on the top of the stream of gas forming the chute 10 and to be accelerated and bounced somewhat upwardly of the chute. This comprises the first stage of deflection of the liquid.

Figure 1:
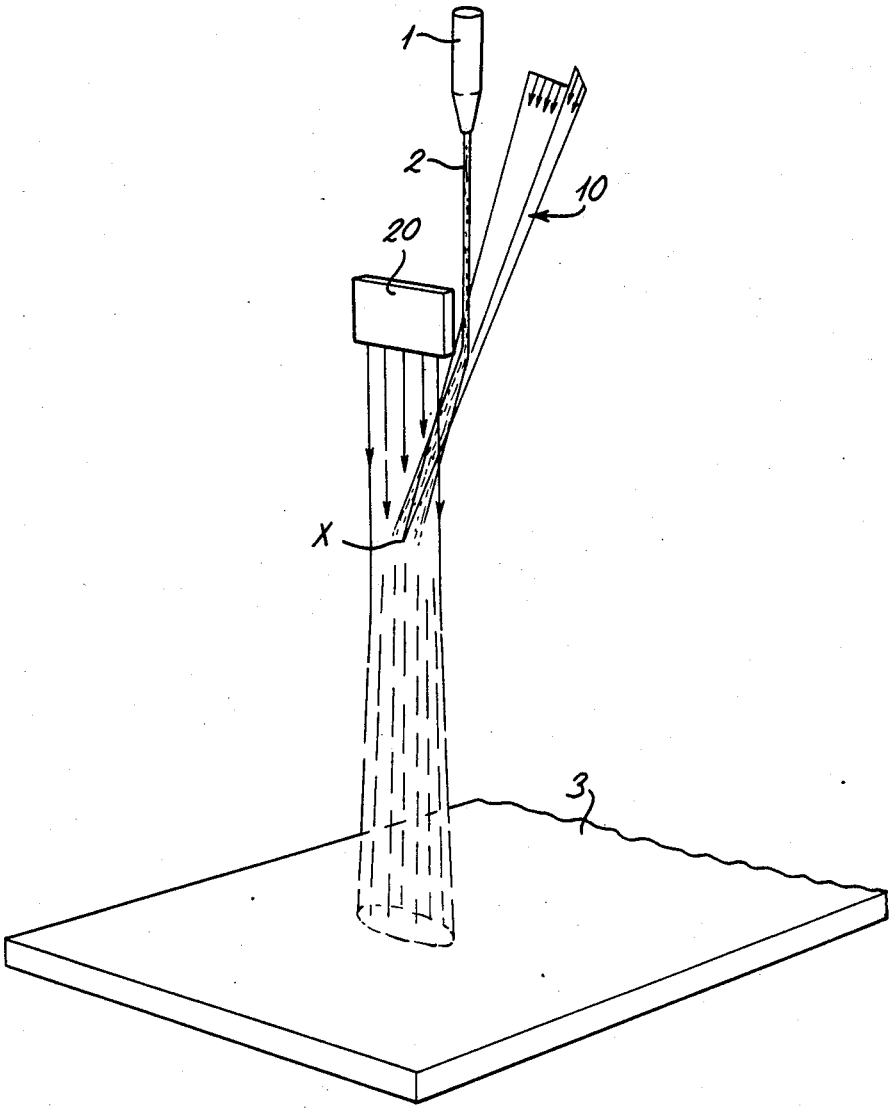
FIG. 1 shows a single gas-knife example.

Turning now, more specifically, to FIG. 1, a fixed nozzle block 20 is mounted pointing vertically downwardly, and produces a vertical downwardly directed sheet of gas in the plane including the point X; the sheet of gas is orthogonal to the horizontal component of the chute 10 and is wide enough to deflect downwardly all, or substantially all, of the already-once-deflected liquid stream 2.

The substrate 3 moves horizontally intersecting this vertical plane, and the liquid is thereby distributed onto it.

Figure 2:
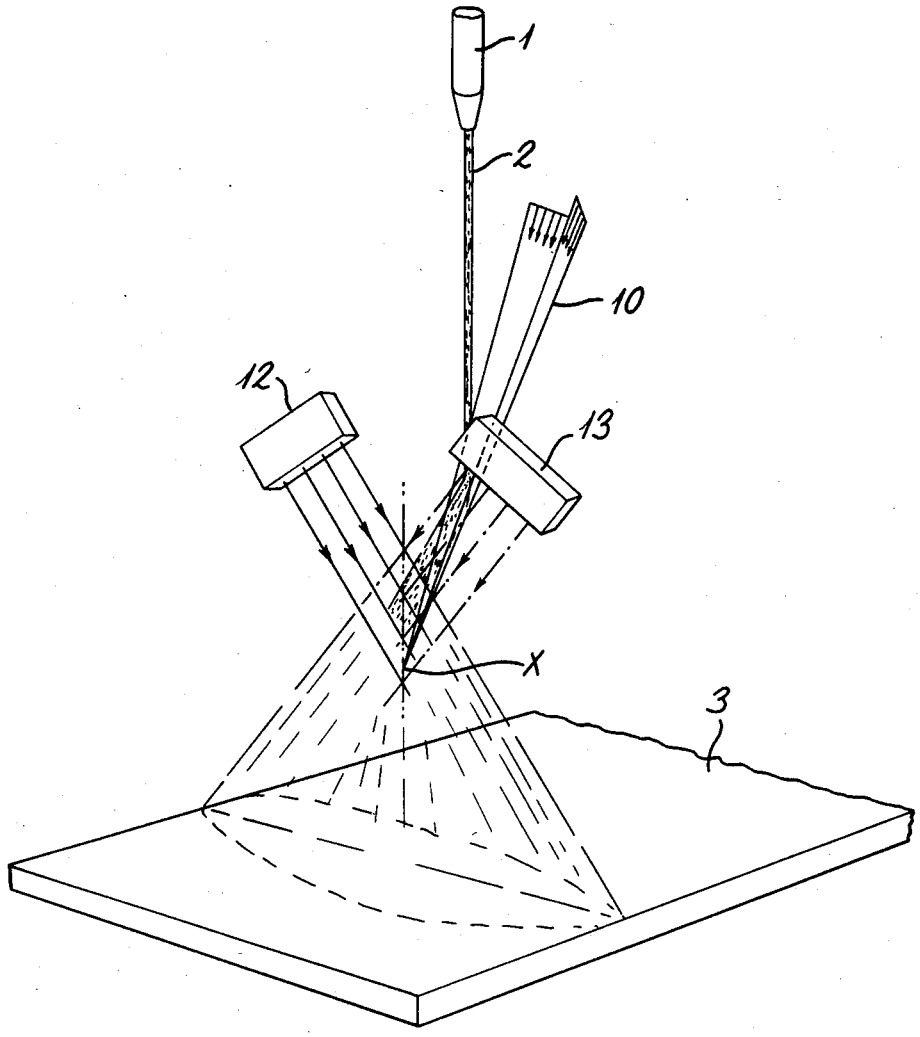
FIG. 2 shows a two alternating gas-knives example.
Figure 3:
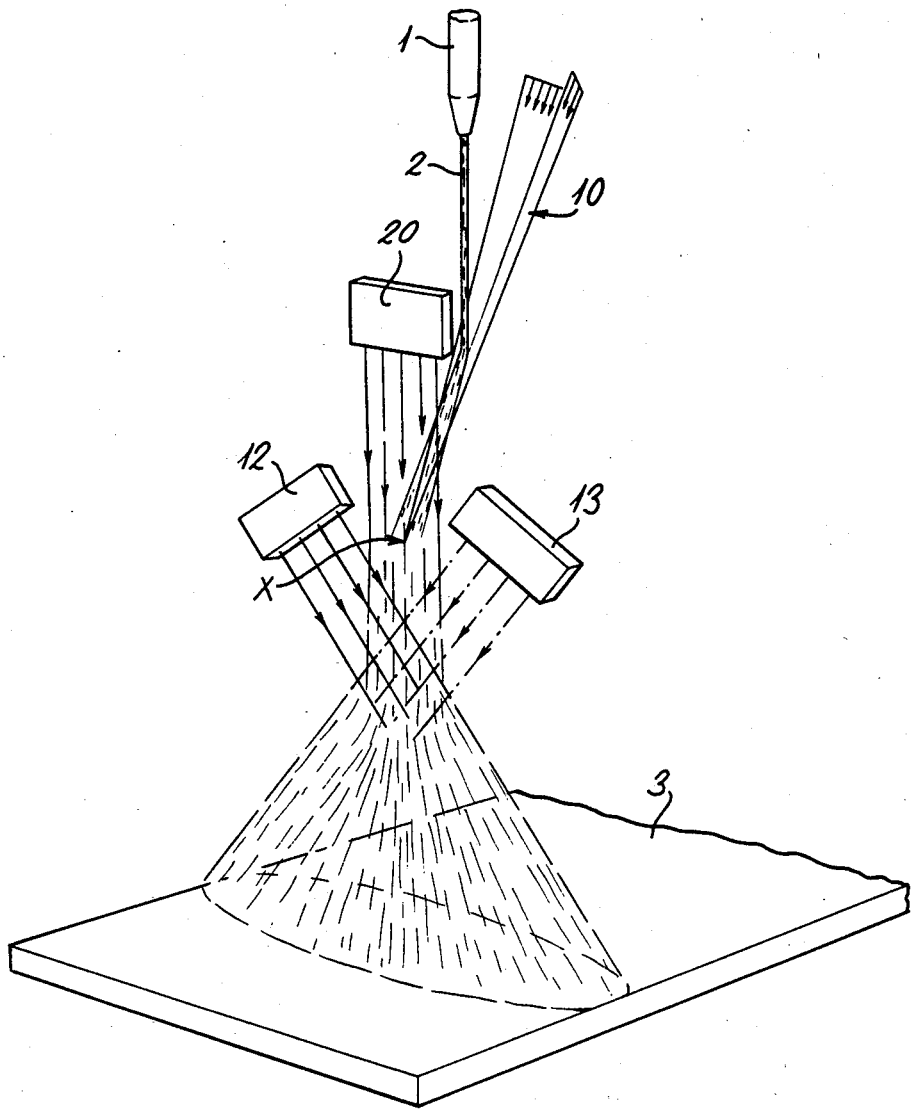
FIG. 3 shows an example where a single gas-knife is followed by two alternating gas-knives.

The distribution may be insufficiently uniform for all purposes, in which case the FIG. 2 arrangement, or better still the FIG. 3 arrangement, may be used.

We turn therefore now to FIG. 2.

Two identical nozzle blocks 12, 13 are disposed in the said vertical plane symmetrically angled with respect to the chute 10. Each block 12, 13 can produce a vertical sheet of gas intersecting the path of the chuting particles from the stream 2, but in each case the sheet has the effect of an air-knife cutting diagonally downwards at 35° to the vertical but still in the vertical plane of the blocks. The chute 10 may be regarded as an injector, injecting the liquid particles into this vertical plane for distribution by the oblique vertical sheet of gas. The point X on which the chute 10 focusses is in this vertical plane. In use, the blocks 12 and 13 are actuated alternately (one or other is firing at any instant) so that a liquid particle entering this vertical plane is subject to one of two gas currents pointing 70° apart, this comprising its second stage of deflection.

The blocks 12, 13 are so sized and placed that the notional vertical diamond, bounding the area which both air-knives cut, contains the point X (i.e. intersects the vertex of the chute 10) close to the bottom of the diamond. Preferably X is somewhere on the bottom quarter of the vertical axis of the diamond. The path of the chuting liquid particles is generally towards the upper half of the diamond. The substrate 3, which is ½ m wide, moves horizontally intersecting this vertical plane about ½ m below the diamond.

Turning now to FIG. 3, the arrangement is a combination of that already described with reference to FIGS. 1 and 2. Thus, the liquid stream 2, after its first stage of deflection and as it enters the vertical plane including the point X, meets the vertical downwardly directed sheet of gas from the fixed nozzle block 20, as described in FIG. 1.

However, unlike FIG. 1, there is interposed between the point X and the substrate a secondary vertical deflection. The two nozzle blocks 12, 13 are disposed, and operate, exactly as in FIG. 2 except that the notional diamond is all below the point X. Thus the second stage of deflection of the stream 2 comprises a primary deflection by the block 20 followed by a secondary deflection by the alternating blocks 12, 13. The result is a well atomised and well distributed deposition of the liquid onto the substrate 3, which in this example might be ½ m below the diamond.

The stream 2 in all three Figures is 4 kg/min of molten zinc-aluminium alloy. The arms of the V of the chute 10 are 15 mm high each. The stream 2 is spaced 12 mm from the vertical plane of the blocks 12, 13, which each provide a gas-knife 20 mm wide. The notional diamond is thus about 6 cm tall. The total gas comsumption by mass is for example gas:metal=1:3–4, the gas being distributed as chute (10) 1 part, diagonal gas-knife (12 or 13) 2 parts, vertical primary block (20) (if present) 2 parts. In the present case the gas consumption (from a supply at an over-pressure of 6 bar) of the chute 10 and of the blocks 12, 13 together would be about 600 liter/-min, but could be lessened. The substrate 3 is advanced at 2 m/min and the gas flow to the blocks 12, 13 alternated at 10 Hz. To lessen deleterious eddies in the free-falling liquid stream 2, the nozzle 1 should be fed by an adequate head of liquid, possibly pressurised.

I claim:

1. A method of distributing liquid onto a substrate comprising deflecting the liquid in two stages wherein, in the first, an unsupported supply of the liquid is allowed to fall into a chute, the chute not being solid but being comprised by a stream of gas, trough-shaped in cross-section, directed downhill; and, in the second, the liquid meets a vertical or near-vertical plane containing: a gas-knife directed towards the substrate; and/or a plurality of sequentially repetitiously fired gas-knives, the directions of flow from which intersect at a point vertically above the centreline of the chute, subtending an angle of up to 80° at that point, below which is the substrate.

2. A method according to claim 1, wherein said unsupported supply is a stream pouring from a nozzle, or formed by striking an arc at one or two consumable electrodes.

3. A method according to claim 1, wherein the chute is a V-shaped trough of gas.

4. A method according to claim 1, wherein the chute is directed downhill at from 15° to 30° to the vertical.

5. A method according to claim 1, wherein the said vertical or near-vertical plane contains one gas-knife directed towards the substrate.

6. A method according to claim 1, wherein the said vertical or near-vertical plane contains a plurality of sequentially repetitiously fired gas-knives, the directions of flow from which intersect at a point vertically above the centreline of the chute.

7. A method according to claim 6, wherein said plurality is two gas-knives firing alternately.

8. A method according to claim 6, wherein the said vertical or near-vertical plane contains additionally a continuously firing gas-knife directed towards the substrate.

9. A method according to claim 8, wherein the liquid in the second stage meets first the gas-knife directed towards the substrate and then the plurality of sequentially repetitiously fired gas-knives.

10. A method according to claim 1, wherein the substrate is moving intersecting said plane.

11. A method according to claim 1, wherein the chute consists of a series of closely-spaced gas jets.

12. A method according to claim 1, wherein the chute is focussed to a point in said plane.

13. A method according to claim 1, wherein the liquid falls into the chute on its centreline.

14. A method according to claim 1, wherein the gas flow in the chute is between one third and one half of the flow through the gas-knife/knives.

15. A method according to claim 1, further comprising rotating the chute and gas-knife/knives about the vertical axis containing the unsupported liquid.

16. Apparatus for distributing liquid onto a substrate, comprising means for forming an unsupported supply of the liquid, means for forming a chute comprised by a stream of gas trough-shaped in cross-section and directed downhill and located to receive the liquid, and: means for forming a gas-knife directed towards the substrate and/or a plurality of sequentially repetitiously fired gas-knives, the directions of flow from which intersect at a point vertically above the centreline of the chute, subtending an angle of up to 80° at that point, below which is the substrate.

17. Apparatus according to claim 16, wherein the chute is directed downhill at from 15° to 30° to the vertical.

18. Apparatus according to claim 16, wherein the means for forming the chute comprise gas jets focussed to a point in the plane containing the gas-knife/knives.

19. Apparatus according to claim 16, further comprising means for moving the substrate in a direction intersecting said gas-knife/knives.

* * * * *

REEXAMINATION CERTIFICATE (1040th)

United States Patent [19]

Jenkins

[11] B1 4,647,471

[45] Certificate Issued Apr. 18, 1989

[54] METHOD OF DISTRIBUTING LIQUID ONTO A SUBSTRATE

[75] Inventor: Walter N. Jenkins, West Glamorgan, Wales

[73] Assignee: National Research Development Corporation, London, England

Reexamination Request:
No. 90/001,456, Mar. 2, 1988

Reexamination Certificate for:

| | |
|---|---|
| Patent No.: | 4,647,471 |
| Issued: | Mar. 3, 1987 |
| Appl. No.: | 829,172 |
| Filed: | Feb. 14, 1986 |

[30] Foreign Application Priority Data

| | | | |
|---|---|---|---|
| Feb. 18, 1985 | [GB] | United Kingdom | 8504047 |
| May 17, 1985 | [GB] | United Kingdom | 8512502 |

[51] Int. Cl.[4] ..... B05D 1/02

[52] U.S. Cl. ..... 427/37; 427/420; 427/421; 427/422; 239/290; 118/300; 118/DIG. 4

[58] Field of Search ..... 427/422, 37, 420, 421; 118/300, DIG. 4; 239/290

[56] References Cited

U.S. PATENT DOCUMENTS

| | | | |
|---|---|---|---|
| 1,654,509 | 12/1927 | Claus | 427/422 X |
| 3,775,156 | 11/1973 | Singer | 427/422 |

FOREIGN PATENT DOCUMENTS 2080357 11/1971 France .

*Primary Examiner*—Shrive P. Beck

[57] ABSTRACT

A liquid stream 2 from a nozzle 1 is atomized and distributed over a substrate 3. The liquid falls into a downwardly angled chute 10 formed by strong gas jets focussed to a point X. An air-knife 20 directed vertically downwardly in the plane of X atomizes the liquid.

Gas-knives 12 and 13 are fired alternately and apply equal but opposite deflections to the liquid, which however remains in the plane of 20. The liquid is then evenly distributed on the substrate 3, which is advanced intersecting the plane of 20.

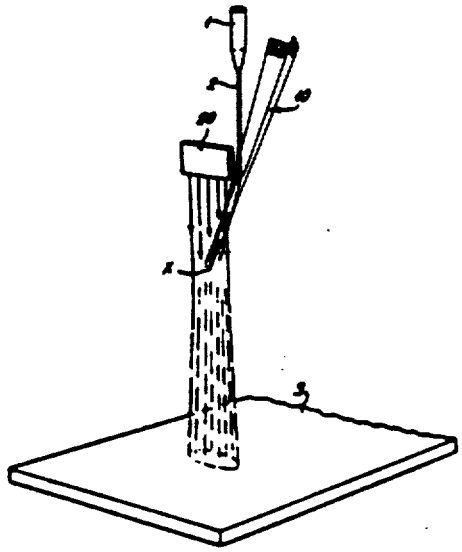

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 5 and 6 are cancelled.

Claims 1, 7, 8, 12, 14–16, 18 and 19 are determined to be patentable as amended.

Claims 2–4, 9–11, 13 and 17, dependent on an amended claim, are determined to be patentable.

New claims 20–23 are added and determined to be patentable.

1. A method of distributing liquid onto a substrate comprising:
deflecting the liquid in two stages wherein,
in the first, an unsupported supply of the liquid is allowed to fall into a chute, the chute not being solid but being comprised by a stream of gas, trough-shaped in cross-section, directed downhill; and,
in the second, the liquid meets a vertical or near-vertical plane containing [: a gas-knife directed towards the substrate; and/or] a plurality of sequentially repetitiously fired gas-knives, the directions of flow from which intersect at a point [vertically above] *on a vertical line including the centreline of the chute, subtending an angle of up to* 80° at that point, below which is the substrate.

7. [A method according to claim 6] *A method of distributing liquid onto a substrate comprising:*
*deflecting the liquid in two stages wherein,*
*in the first, an unsupported supply of the liquid is allowed to fall into a chute, the chute not being solid but being comprised by a stream of gas, trough-shaped in cross-section, directed downhill; and,*
*in the second, the liquid meets a vertical or near-vertical plane containing two sequentially repetitiously and alternately fired gas-knives, the directions of flow from which intersect at a point on a vertical line including the center line of the chute, subtending an angle of up to 80° at that point, below which is the substrate* [wherein said plurality is two gas knives alternately firing].

8. [A method according to claim 6] *A method of distributing liquid onto a substrate comprising:*
*deflecting the liquid in two stages wherein,*
*in the first, an unsupported supply of the liquid is allowed to fall into a chute, the chute not being solid but being comprised by a stream of gas, trough-shaped in cross-section, directed downhill; and,*
*in the second, the liquid meets a vertical or near-vertical plane containing a plurality of sequentially repetitiously fired gas-knives, the directions of flow from which intersect at a point on a vertical line including the centerline of the chute, subtending an angle of up to 80° at that point, below which is the substrate,* wherein the said vertical or near-vertical plane contains additionally a continuously firing gas-knife directed towards the substrate.

12. [A method according to claim 1] *A method of distributing liquid onto a substrate comprising:*
*deflecting the liquid in two stages wherein,*
*in the first, an unsupported supply of the liquid is allowed to fall into a chute, the chute not being solid but being comprised by a stream of gas, trough-shaped in cross-section, directed downhill; and,*
*in the second, the liquid meets a vertical or near-vertical plane containing a plurality of sequentially repetitiously fired gas-knives, the directions of flow from which intersect at a point on a vertical line including the centerline of the chute, subtending an angle of up to 80° at that point, below which is the substrate* wherein the chute is focussed to a point in said plane.

14. [A method according to claim 1] *A method of distributing liquid onto a substrate comprising:*
*deflecting the liquid in two stages wherein,*
*in the first, an unsupported supply of the liquid is allowed to fall into a chute, the chute not being solid but being comprised by a stream of gas, trough-shaped in cross-section, directed downhill; and,*
*in the second, the liquid meets a vertical or near-vertical plane containing a plurality of sequentially repetitiously fired gas-knives, the directions of flow from which intersect at a point on a vertical line including the centerline of the chute, subtending an angle of up to 80° at that point, below which is the substrate* wherein the gas flow in the chute is between one third and one half of the flow through the gas-[knife/]knives.

15. [A method according to claim 1] *A method of distributing liquid onto a substrate comprising:*
*deflecting the liquid in two stages wherein,*
*in the first, an unsupported supply of the liquid is allowed to fall into a chute, the chute not being solid but being comprised by a stream of gas, trough-shaped in cross-section, directed downhill;*
*in the second, the liquid meets a vertical or near-vertical plane containing a plurality of sequentially repetitiously fired gas-knives, the directions of flow from which intersect at a point on a vertical line including the centerline of the chute, subtending an angle of up to 80° at that point, below which is the substrate; and* [further comprising]
rotating the chute and gas-[knife/]knives about the vertical axis containing the unsupported liquid.

16. Apparatus for distributing liquid onto a substrate, comprising:
means for forming an unsupported supply of the liquid, means for forming a chute comprised by a stream of gas trough-shaped in cross-section and directed downhill and located to receive the liquid, and [:]
means for forming a [gas-knife directed towards the substrate and/or a] plurality of sequentially repetitiously fired gas-knives, the directions of flow from which intersect at a point [vertically above] *on a vertical line including* the centreline of the chute, subtending an angle of up to 80° at that point, below which is the substrate.

18. Apparatus according to claim 16, wherein the means for forming the chute comprise gas jets focussed to a point in the plane containing the gas-[knife/]knives.

19. Apparatus according to claim 16, further comprising means for moving the substrate in a direction intersecting said gas-[knife/]knives.

*20. An apparatus according to claim 16 wherein said means for forming the plurality of sequentially repetitiously fired gas-knives forms two gas-knives firing alternately.*

*21. An apparatus as in claim 16 wherein said vertical line additionally includes a continuously firing gas-knife directed toward the substrate.*

*22. An apparatus as in claim 21 wherein said liquid meets said gas-knife directed towards the substrate first, and then meets the plurality of sequentially repetitiously fired gas-knives.*

*23. An apparatus as in claim 16 wherein said means for forming a chute forms a chute which is focused to a point on said vertical line.*

* * * * *